US007241210B2

(12) United States Patent
Van Vliet

(10) Patent No.: US 7,241,210 B2
(45) Date of Patent: Jul. 10, 2007

(54) FLOOR TREATING MACHINE COMPRISING INDIVIDUALLY DRIVEN DISCS

(75) Inventor: Johannes Petrus Van Vliet, Alphen A/D Rijn (NL)

(73) Assignee: Holland Industriele Diamantwerken B.V., Ter Arr (NL)

( * ) Notice: Subject to any disclaimer, the term of this patent is extended or adjusted under 35 U.S.C. 154(b) by 0 days.

(21) Appl. No.: 11/206,799

(22) Filed: Aug. 19, 2005

(65) Prior Publication Data

US 2006/0026781 A1 Feb. 9, 2006

(51) Int. Cl.
*B24B 27/08* (2006.01)

(52) U.S. Cl. ..... 451/353

(58) Field of Classification Search ..... 451/353
See application file for complete search history.

(56) References Cited

U.S. PATENT DOCUMENTS 2,007,073 A * 7/1935 Clarke ..... 15/49.1
2,171,060 A * 8/1939 De Spirt ..... 451/353
3,128,581 A * 4/1964 Tosetti ..... 451/353
3,496,681 A * 2/1970 Oswald ..... 451/353
4,186,967 A * 2/1980 Kuhmonen ..... 299/25
4,273,384 A * 6/1981 Freeburn ..... 299/41.1
4,570,388 A * 2/1986 Tano et al. ..... 451/353
4,709,510 A * 12/1987 Giovanni et al. ..... 451/353
4,719,659 A * 1/1988 Urakami ..... 15/49.1
6,238,277 B1 * 5/2001 Duncan et al. ..... 451/271
7,022,004 B2 * 4/2006 Bohler ..... 451/366
7,033,258 B2 * 4/2006 Jordan ..... 451/350

* cited by examiner

*Primary Examiner*—M. Rachuba
(74) *Attorney, Agent, or Firm*—Young & Thompson

(57) ABSTRACT

A floor treating machine includes a frame provided with a housing which is supported with respect to the frame in such a manner that it can rotate about a substantially vertical housing axis, at least three heads positioned at intervals around the axis and rotatably mounted to the housing, the axis of each head being about parallel to the housing axis, and each head having a bottom surface provided with treating elements and/or coupling elements for treating members to be coupled to, and a motor on the frame which is in driving interaction with the housing and the heads via respective transmissions. At least two of the heads are drivable by separate respective head transmissions each comprising a head pulley connected to the respective head, a drive pulley interacting with the motor as well as a belt between each pair of a head pulley and a drive pulley.

8 Claims, 3 Drawing Sheets

FLOOR TREATING MACHINE COMPRISING INDIVIDUALLY DRIVEN DISCS

The invention is related to a floor treating machine, comprising a frame provided with a housing which is supported with respect to the frame in such a manner that it can rotate about a substantially vertical housing axis, at least three heads positioned at intervals around said axis and rotatably mounted to the housing, the axis of each head being about parallel to the housing axis, and each head having a bottom surface provided with treating means and/or coupling means for treating means to be coupled to, and a motor on the frame which is in driving interaction with the housing and the heads by means of respective transmissions.

Such a prior art floor treating machine is disclosed in European patent application 700327. Said floor treating machine comprises three heads, which are driven by means of a drive belt. To that end, said drive belt is guided around three head pulleys, as well as around a drive pulley which is connected to the motor shaft. In such arrangement, the full power of the motor is transmitted through the drive pulley and the drive belt interacting therewith. In order to ascertain that the drive belt can withstand the full motor power, a relatively wide belt has to be selected. As this belt is guided around the head pulleys as well, these head pulleys should be laid out for this width as well. This means that each head is equipped with a head pulley which is larger than necessary. After all, each pulley consumes only a fraction of the total power delivered by the motor. As a result, the transmission including drive pulley, head pulleys and the drive belt is a relatively heavy. As explained, this is caused by the fact that the full motor power has to be transmitted through the drive pulley and the drive belt.

The object of the invention is to provide a floor treating machine of the type discussed before, which can be of a lighter, and thereby more efficient, construction. Said object he is achieved in that at least two of the heads are drivable by means of separate respective transmissions each comprising a head pulley connected to the respective head, a drive pulley interacting with the motor as well as a belt between each pair of a head pulley and a drive pulley.

In the floor treating machine according to the invention, the transmissions between the motor and the individual heads are not designed for transmitting the full motor power, but for transmitting only the power which is consumed by each of said heads separately. This is obtained by the construction in which each head has been given its own transmission including belts and pulleys. These transmissions can therefore have a belt and pulleys with a smaller width, and can therefore be lighter, as the power to be transmitted through each belt is smaller. Consequently, the complete construction including shafts, bearings and the bearing housings can be smaller and thereby lighter as well, which results in a lighter and therefore more cost efficient construction.

As is the case in the prior art floor treating machine, a drive shaft can be provided which is concentric with respect to the housing axis, which is rotatably supported with respect to the frame and which interacts with the motor. In the floor treating machine according to the invention, the drive pulleys are all connected to said drive shaft. Furthermore, the housing can be rotatably supported with respect to the drive shaft.

The floor treating machine according to the invention can be carried out in different ways. For instance the position of the motor can be selected freely and also the transmission between the motor and the housing can for instance be carried out with tooth gears. Preferably however, the drive shaft is concentric with respect to the motor shaft.

In the floor treating machine according to the invention, the head transmissions are staggered with respect to each other. Thus, the several transmissions which each drive one of the heads are positioned above each other as well.

In a known way, each head can be supported on a head shaft, each head shaft being suspended with respect to the housing by means of an upper bearing and a lower bearing.

As mentioned before, the transmission between the motor and the housing can be carried out in several ways. Preferably however, said transmission between the motor and the housing comprises at least one auxiliary drive belt. Furthermore, said transmission may comprise a frame pulley connected to the frame, the first auxiliary belt being applied around said frame pulley and a first auxiliary pulley which is rotatably supported with respect to the housing for rotating the housing with respect to the frame. Additionally, a second auxiliary pulley can be coaxially connected to the first auxiliary pulley, a drive shaft pulley being connected to the drive shaft, and a second auxiliary belt being applied around said second auxiliary pulley and the drive shaft pulley.

A well protected embodiment is obtained in case a frame covering is provided, wherein the transmissions are fully contained within the frame covering.

The invention will now be described further with reference to an embodiment of the floor treating machine as shown in the drawings.

Figure 1:
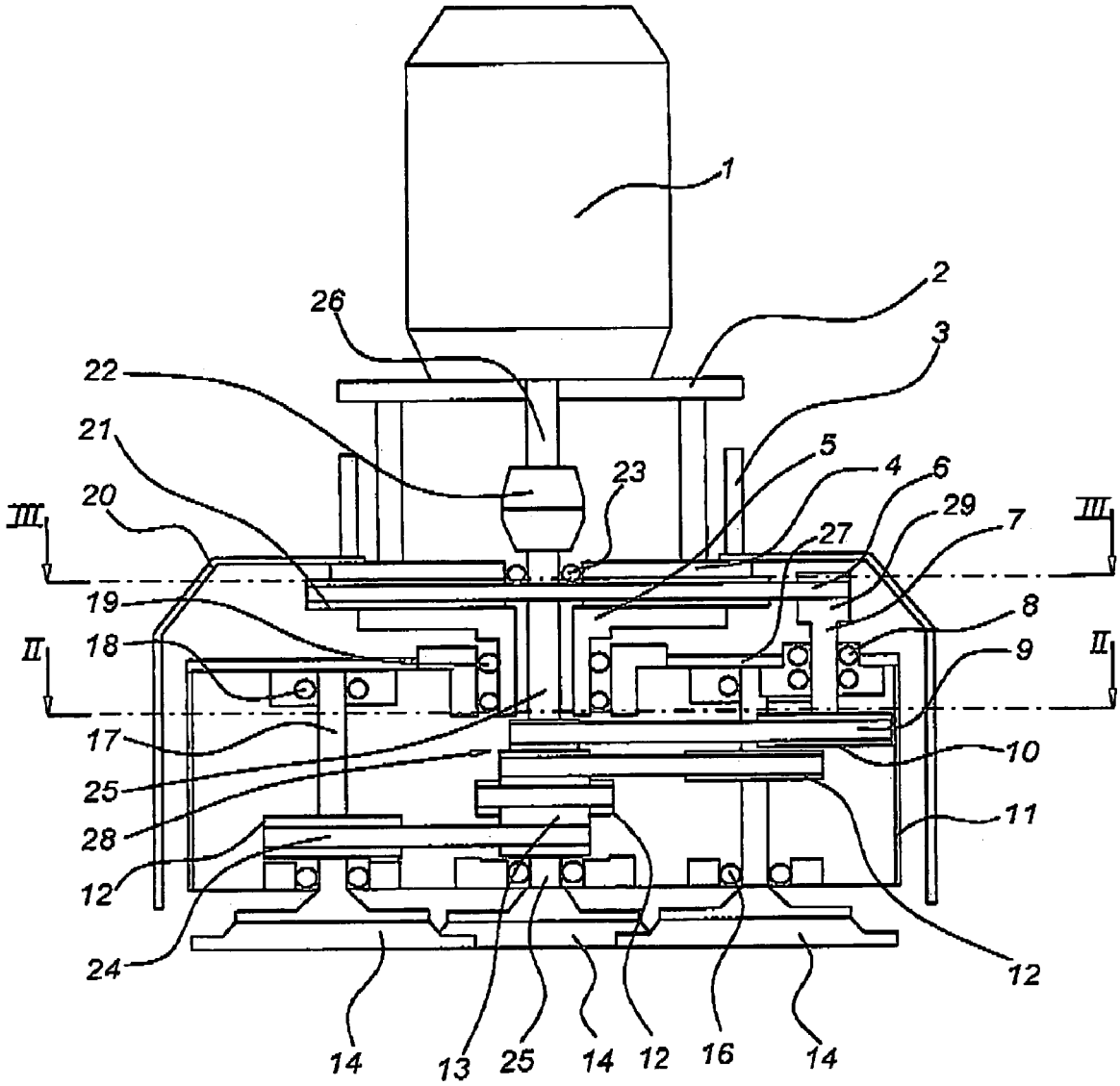
FIG. 1 shows a side view, in section, of the floor treating machine.
Figure 2:
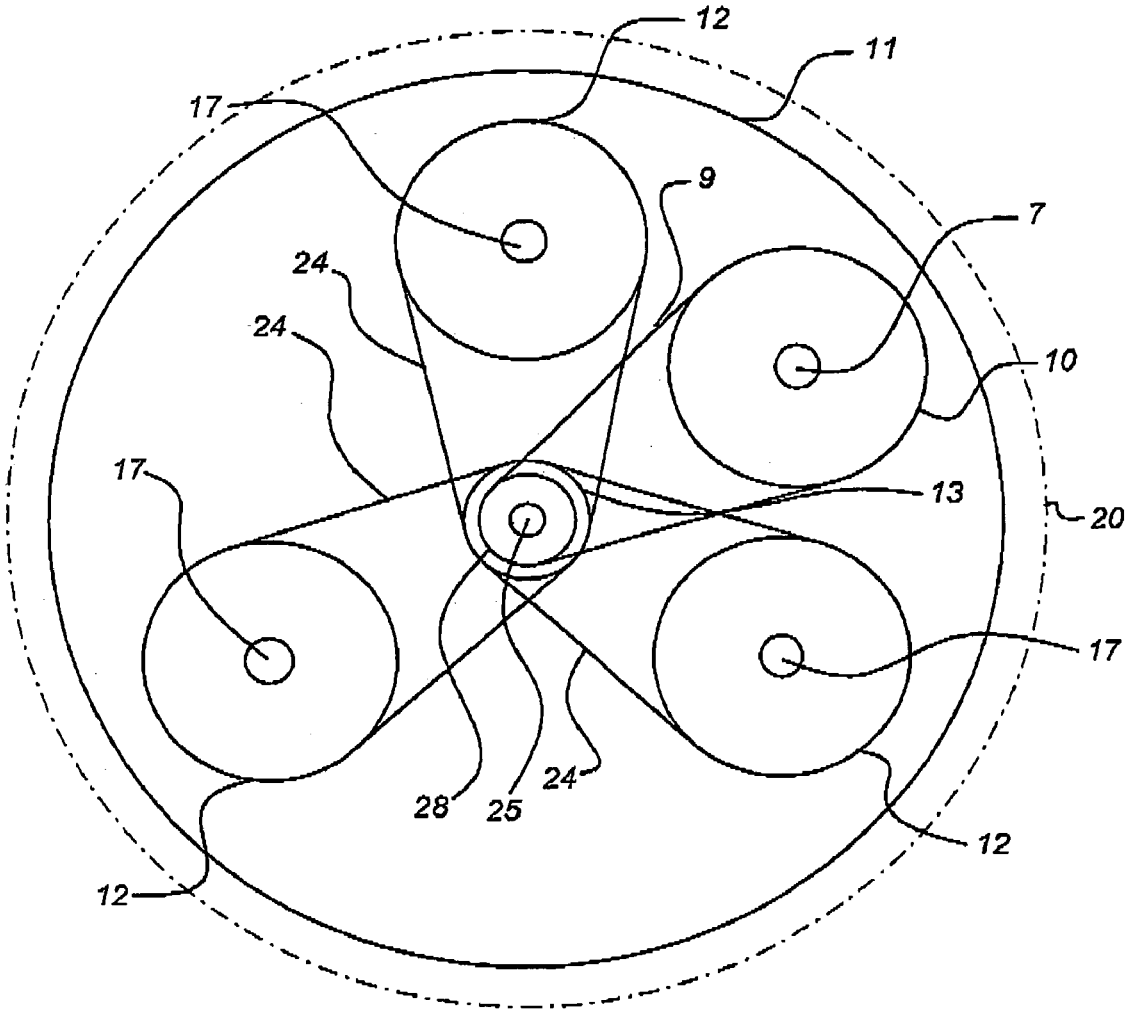
FIG. 2 shows the section according to II—II of FIG. 1.
Figure 3:
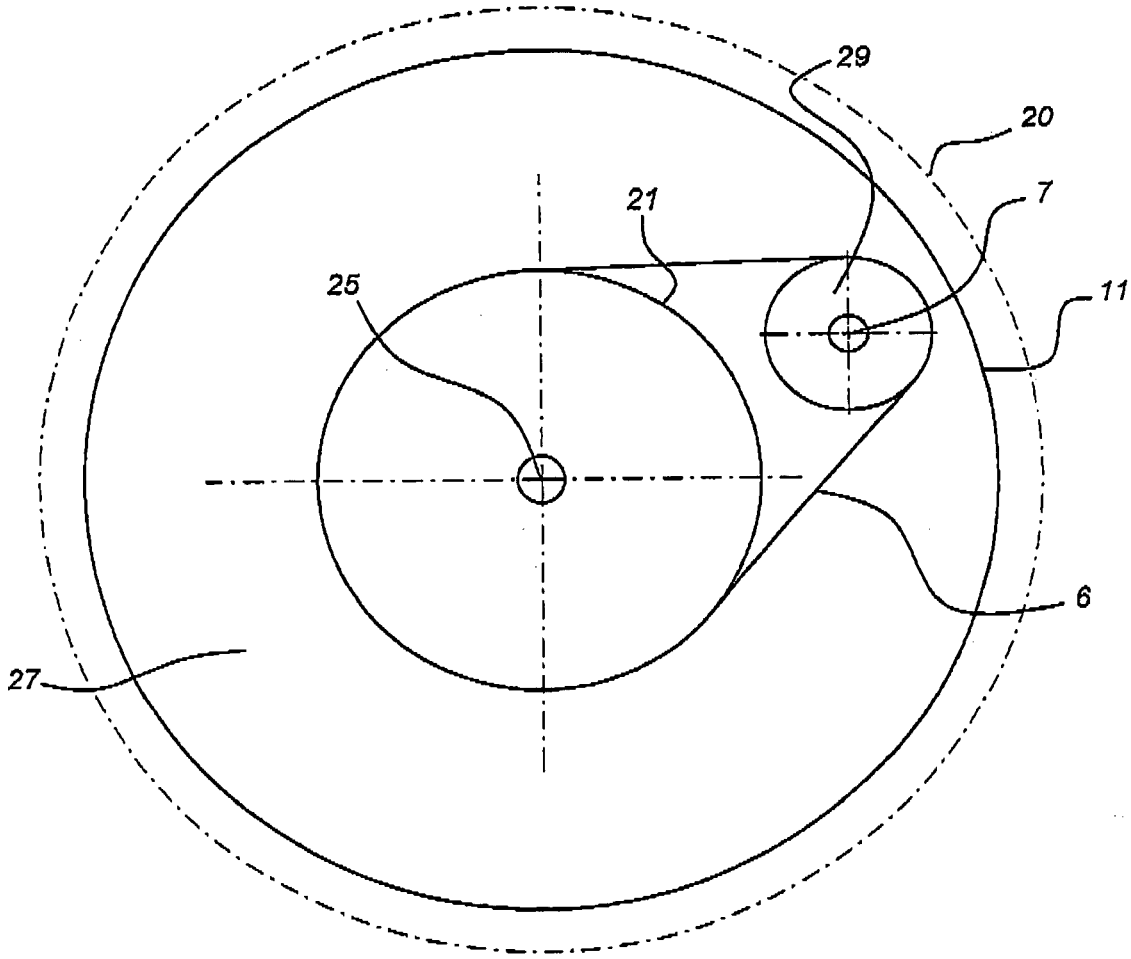
FIG. 3 shows the section according to III—III of FIG. 1.

The floor treating machine as shown in the figures comprises a housing 11, which by means of the bearings 19 is rotatably supported with respect to the drive shaft 25. Said drive shaft 25 in turn is rotatably supported with respect to the frame 20 by means of the drive shaft bearing 23. The frame 20 carries a motor support 2, carrying the motor 1. The motor shaft 26 of the motor 1 is connected to the drive shaft 25 by means of the coupling 22.

The heads 14 each comprises a head shaft 17, which head shaft 17 are rotatably supported with respect to the housing 11 by means of a lower head bearing 16 and an upper head bearing 18. These head shafts 17 each support a head pulley 12; it is to be noted that the several head pulleys 17 are positioned at different levels on the corresponding head shafts 17.

Equally, three drive pulleys 28 are positioned at similarly different levels on the drive shaft 25. Between each pair of a drive pulley 28 and a head pulley 12 which are at the same level, a belt 9 is positioned. Thus, each head 14 and thereby each disc holder positioned at the bottom of each head 14 is driven by its own belt/pulley drive.

The transmission between the drive shaft 25 and the housing 11 also contains belt/pulley drives. In this connection, the drive shaft pulley 28 has been provided. Furthermore, a second auxiliary pulley 10 has been provided, as well as a first auxiliary pulley 29. These auxiliary pulleys 10, 29 are mounted on an intermediate shaft 7, which by means of the bearing 8 is rotatably supported with respect to the housing 11.

Furthermore, a frame pulley 21 has been provided, which is fixed with respect to the fame 20. A first auxiliary belt 6 is provided around said frame pulley 21 and the first auxiliary pulley 29. A second auxiliary belt 9 is provided between the drive shaft pulley 28 and the second auxiliary pulley 29. Thus, the housing 11 can be rotated as a result of the rolling action of the first auxiliary pulley 29 along the first auxiliary belt 6, which is held in a fixed position around the frame pulley 21.

A frame cover 31 is connected to the frame 21, which frame covering 31 covers both the housing 11 as well as the transmission between the frame and the housing.

The invention claimed is:

1. Floor treating machine, comprising a frame (20) provided with a housing (11) which is supported with respect to the frame (20) in such a manner that it can rotate about a substantially vertical housing axis, at least three heads (14) positioned at intervals around said axis and rotatably mounted to the housing (11), the axis of each head (11) being about parallel to the housing axis, and each head (11) having a bottom surface provided with treating means and/or coupling means for treating means to be coupled to, and a motor (1) on the frame (20) which is in driving interaction with the housing (11) and the heads (14) by means of respective transmissions (12, 13, 24; 6, 9, 10, 21, 28, 29), at least two of the heads (14) being drivable by means of separate respective head transmissions each comprising a head pulley (12) connected to the respective head (14), a drive pulley (13) interacting with the motor (1) as well as a belt (9) between each pair of a head pulley (12) and a drive pulley (13), wherein the transmission between the motor (1) and the housing (11) comprises at least one auxiliary drive belt (6), a frame pulley (21) connected to the frame (20), the first auxiliary belt (6) being applied around said frame pulley (20) and a first auxiliary pulley (29) which is rotatably supported with respect to the housing (II) for rotating the housing (11) with respect to the frame (20), and a second auxiliary pulley (10) coaxially connected to the first auxiliary pulley (29), a drive shaft pulley (28) connected to the drive shaft (25), and a second auxiliary belt (9) applied around said second auxiliary pulley (10) and the drive shaft pulley (29).

2. Floor treating machine according to claim 1, wherein a drive shaft (25) is provided which is concentric with respect to the housing axis, which is rotatably supported with respect to the frame (20) and which interacts with the motor (1), the drive pulleys (13) being connected to said drive shaft (25).

3. Floor treating machine according to claim 2, wherein the housing (11) is rotatably supported with respect to the drive shaft (25).

4. Floor treating machine according to claim 2, wherein the drive shaft (25) is concentric with respect to the motor shaft (26).

5. Floor treating machine according to claim 1, wherein the head transmission (12, 13, 24, 28) are staggered with respect to each other.

6. Floor treating machine according to claim 1, wherein each head (14) is supported on a head shaft (17), each head shaft (17) being suspended with respect to the housing (11) by means of an upper bearing (18) and a lower bearing (16).

7. Floor treating machine according to claim 1, wherein a frame covering (31) is provided, the transmission between the drive shaft (25) and the housing (11) being fully contained within said frame covering (31).

8. Floor treating machine according to claim 2, wherein the drive shaft (25) is concentric with respect to the motor shaft (26).

* * * * *